US010240743B2

(12) United States Patent
Okubo

(10) Patent No.: US 10,240,743 B2
(45) Date of Patent: Mar. 26, 2019

(54) VEHICULAR LIGHT

(71) Applicant: ICHIKOH INDUSTRIES, LTD., Isehara-shi, Kanagawa-ken (JP)

(72) Inventor: Yasuhiro Okubo, Isehara (JP)

(73) Assignee: ICHIKOH INDUSTRIES, LTD., Isehara-shi (JP)

( * ) Notice: Subject to any disclaimer, the term of this patent is extended or adjusted under 35 U.S.C. 154(b) by 0 days.

(21) Appl. No.: 15/578,456

(22) PCT Filed: Jun. 1, 2016

(86) PCT No.: PCT/JP2016/066210

§ 371 (c)(1),
(2) Date: Nov. 30, 2017

(87) PCT Pub. No.: WO2016/194954

PCT Pub. Date: Dec. 8, 2016

(65) Prior Publication Data

US 2018/0156408 A1 Jun. 7, 2018

(30) Foreign Application Priority Data

Jun. 2, 2015 (JP) ..... 2015-112185

(51) Int. Cl.

| | |
|---|---|
| ***F21S 41/20*** | (2018.01) |
| ***F21S 41/43*** | (2018.01) |
| ***F21S 41/663*** | (2018.01) |
| ***F21S 41/143*** | (2018.01) |
| ***F21S 43/00*** | (2018.01) |
| ***F21S 41/00*** | (2018.01) |

(Continued)

(52) U.S. Cl.
CPC ..... *F21S 41/285* (2018.01); *F21S 41/00* (2018.01); *F21S 41/143* (2018.01); *F21S 41/16* (2018.01); *F21S 41/192* (2018.01); *F21S 41/28* (2018.01); *F21S 41/43* (2018.01); *F21S 41/663* (2018.01); *F21S 43/00* (2018.01); *F21Y 2115/10* (2016.08); *F21Y 2115/30* (2016.08)

(58) Field of Classification Search
CPC ..... F21S 41/285; F21S 41/28; F21S 41/43; F21S 41/663; F21S 41/143; F21S 41/16; F21S 41/192
See application file for complete search history.

(56) References Cited

U.S. PATENT DOCUMENTS

2015/0103551 A1* 4/2015 Tanaka ..... F21S 41/143 362/520

FOREIGN PATENT DOCUMENTS

| | | | |
|---|---|---|---|
| JP | 2008-226558 | A | 9/2008 |
| JP | 2008-262755 | A | 10/2008 |

(Continued)

*Primary Examiner* — Thomas M Sember
(74) *Attorney, Agent, or Firm* — Foley & Lardner LLP

(57) ABSTRACT

The objective of the invention is to provide a vehicular light equipped with an odd-shaped lens wherein light distribution loss has been suppressed. This vehicular light is equipped with: a light source unit comprising at least five light-emitting chips disposed horizontally; and an odd-shaped lens having a convex entry surface on the light source unit side and a convex exit surface in the direction leaving from the light source unit, wherein the entry surface comprises a free-form curved surface whereof the horizontal curvature radius increases gradually from the lens optical axis Z in the outward direction.

9 Claims, 7 Drawing Sheets

(51) Int. Cl.

| | |
|---|---|
| ***F21S 41/16*** | (2018.01) |
| ***F21S 41/19*** | (2018.01) |
| *F21Y 115/30* | (2016.01) |
| *F21Y 115/10* | (2016.01) |

(56) References Cited

FOREIGN PATENT DOCUMENTS

| | | | |
|---|---|---|---|
| JP | 2013-152844 | A | 8/2013 |
| JP | 2015-076375 | A | 4/2015 |
| WO | WO-2009/0072670 | A1 | 6/2009 |

* cited by examiner

[FIG. 1]
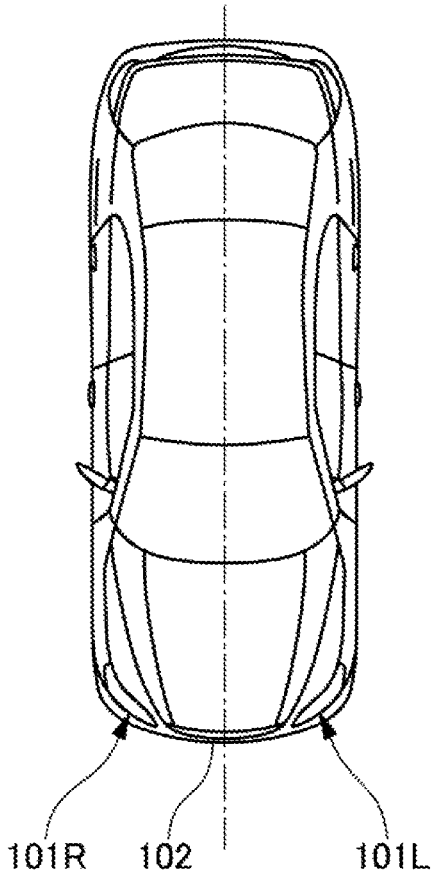

[FIG. 2]
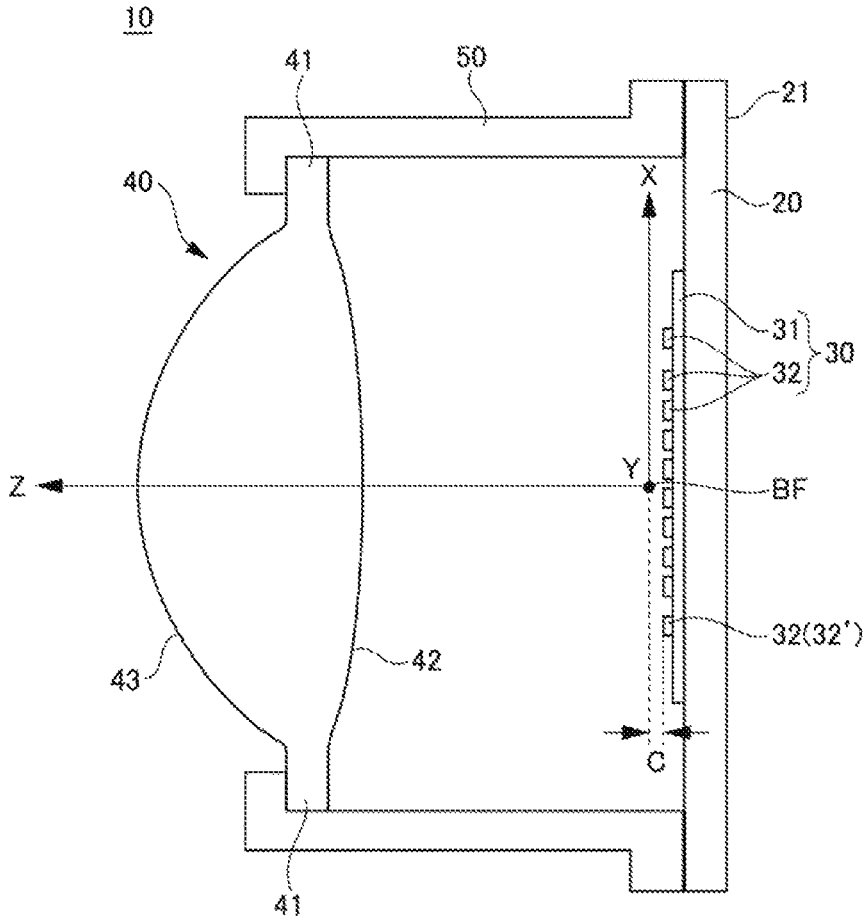

[FIG. 3]
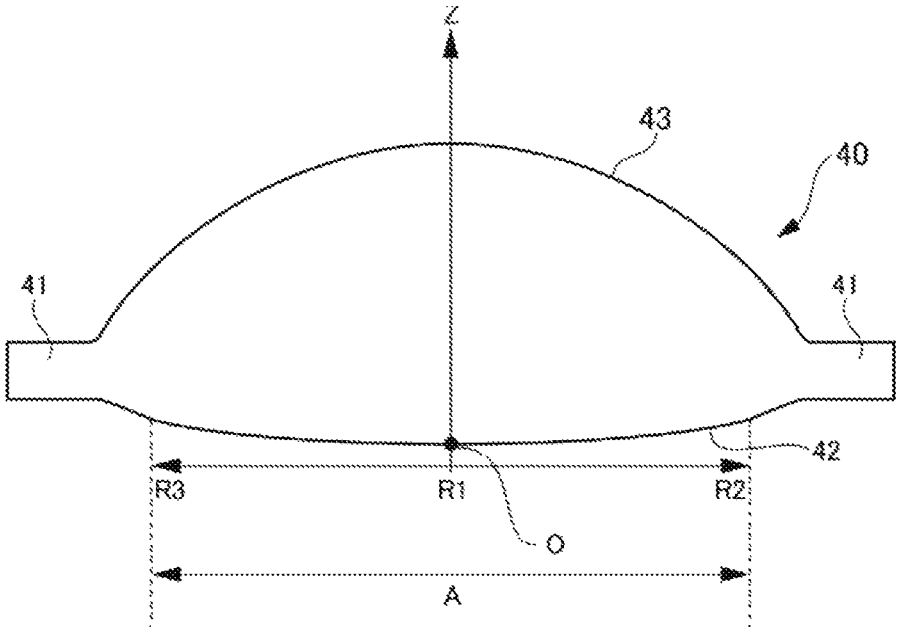
[FIG. 4]
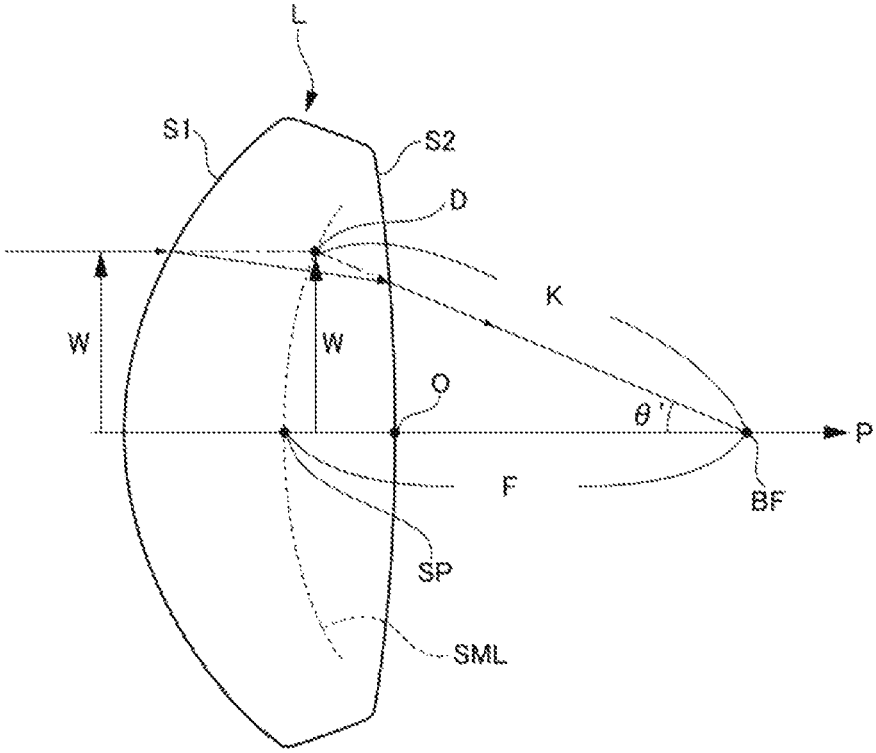

[FIG. 5]
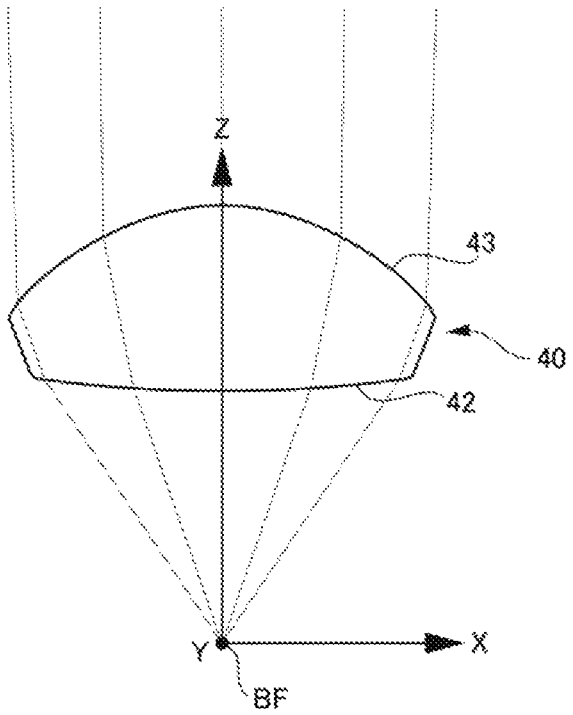
[FIG. 6]
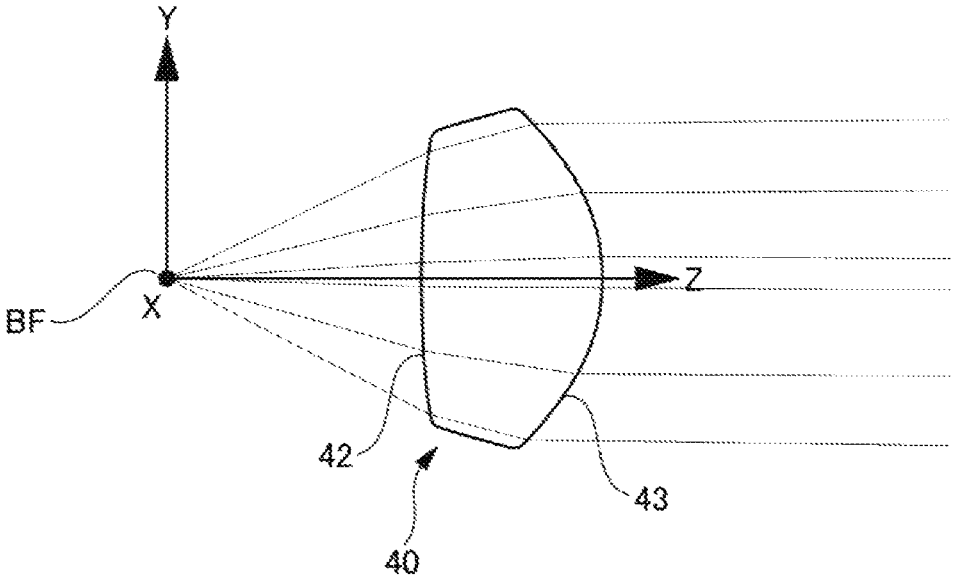

[FIG. 7]
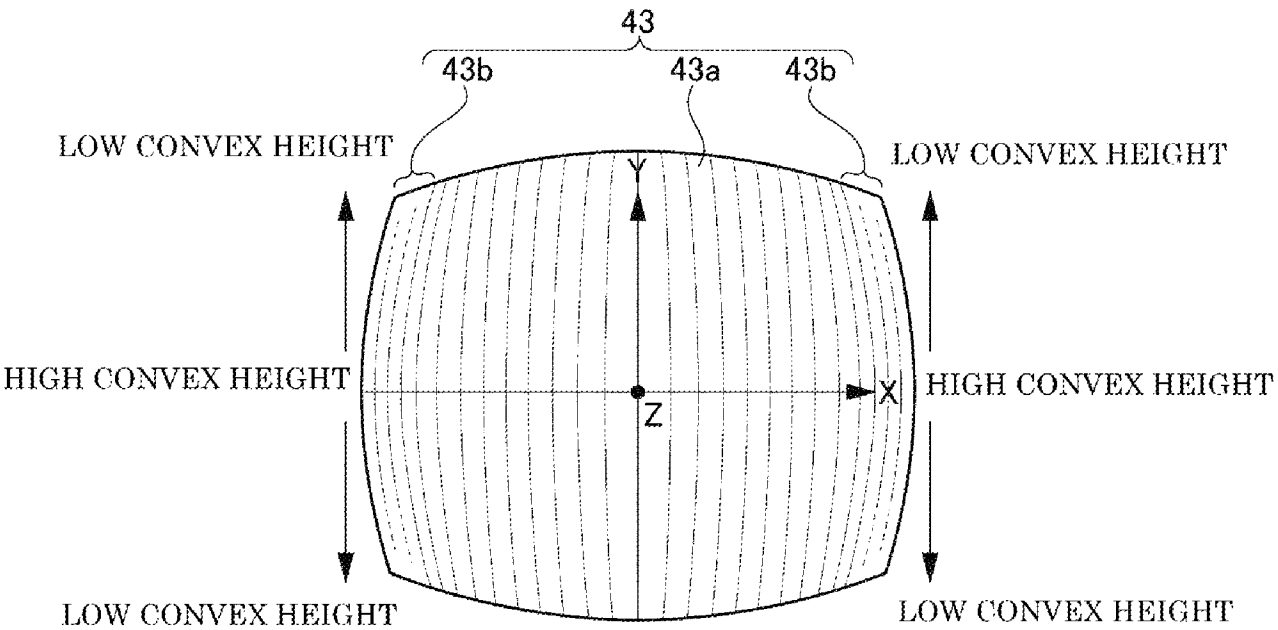

[FIG. 8]
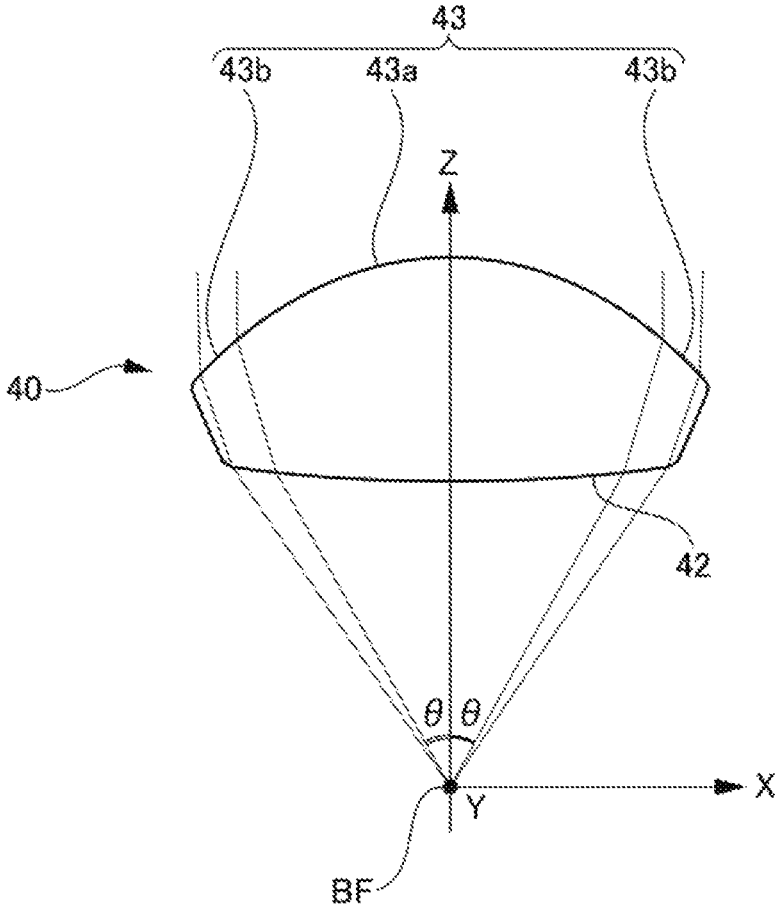

[FIG. 9]
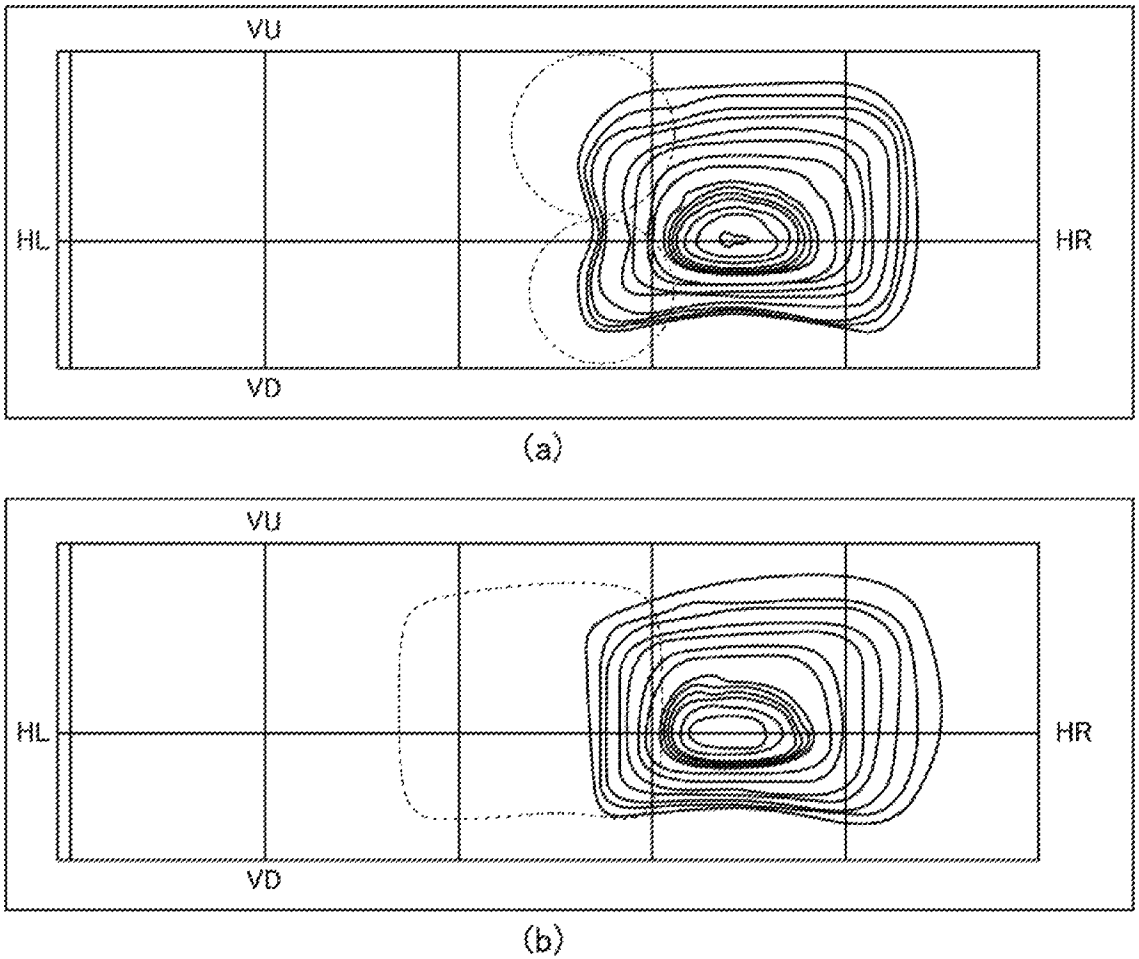

VEHICULAR LIGHT

TECHNICAL FIELD

The present invention relates to a vehicular light.

BACKGROUND ART

Conventionally, a vehicular front light is known that uses a light source in which a plurality of semiconductor light emitting elements are lined up in the horizontal direction (see Patent Literature 1).

More specifically, the vehicular front light disclosed in Patent Literature 1 includes semiconductor light emitting elements used as a light source, and a projection lens that projects light emitted from the semiconductor light emitting elements and radiates the projected light from an irradiation surface to the outside. The projection lens is formed with at least the center part of the irradiation surface as a first control portion, and at least a portion of at least an outer peripheral portion of the irradiation surface as a second control portion. Also, light emitted from a light emitting point on an optical axis that passes through a focal point of the projection lens is radiated from the first control portion as parallel light that is parallel to the optical axis, and is radiated from the second control portion to the outside with respect to a line segment that is parallel to the optical axis, and at least the first control portion of the projection lens is formed as an diffusion portion that diffuses light.

Patent Literature 1 discloses that, due to such characteristics, the blue component of the light emitted from the semiconductor light emitting elements will not easily reach the outer peripheral portion of the light distribution pattern, and thus chromatic aberration will not easily occur. In addition, light radiated from the diffusion portion diffuses and tends to mix with the blue component. As a result, the generation of the color blue in the light distribution pattern is suppressed, so a good light distribution pattern is able to be formed.

PRIOR ART DOCUMENTS PATENT LITERATURE

Patent Literature 1: Japanese Unexamined Patent Application Publication No. 2013-152844

SUMMARY OF THE INVENTION

Problems to be Solved by the Invention

With a configuration in which a plurality of light emitting elements are arranged lined up in this way, there will also be light emitting elements in positions away from the lens focal point of the projection lens. Therefore, the light distribution patterns from the light from the light emitting elements positioned to the outside may deteriorate due to coma aberration. However, with the vehicular front light described in Patent Literature 1, the problem of such coma aberration is not taken into account.

With the vehicular front light described in Patent Literature 1, an aspherical lens having a circular outer shape is used as the projection lens. The light distribution deterioration due to coma aberration becomes even more pronounced when the lens has an outer shape that is not circular, but odd-shaped (for example, a rectangle (a rhombus or a parallelogram), or an outer shape that not a true circle but is enclosed by a curved line as represented by an ellipse).

The present invention has been made in view of the problem described above, and it is an object of the present invention to provide a vehicular light that includes an odd-shaped lens that suppresses light distribution deterioration.

Solution to Problem

In order to achieve the above object, the present invention is realized by the following constitution.

(1) A vehicular light of the present invention comprising:

a light source unit having at least five or more light emitting chips arranged in a horizontal direction; and an odd-shaped lens having a convex-shaped incident surface on the light source unit side and a convex-shaped light emission surface in a direction away from the light source unit, wherein the incident surface is formed with a freeform curve in which a curvature radius in the horizontal direction gradually increases from a lens optical axis toward an outside.

(2) The vehicular light of the present invention (1) above, wherein the light emission surface is formed with a freeform curve including one in which, when light is radiated onto the incident surface from a basic focal point on the lens optical axis, light radiated forward from the light emission surface gradually spreads toward the outside from the lens optical axis when viewed in the horizontal direction, and gradually spreads upward on a side above the lens optical axis, and is parallel on a side below the lens optical axis when viewed in a vertical direction, and the light source unit is arranged such that the light emitting chips are positioned behind the basic focal point.

(3) The vehicular light of the present invention (1) above, wherein the incident surface is formed such that the curvature radius gradually increases from the lens optical axis toward the outside in a radial fashion including the vertical direction and a diagonal direction.

(4) The vehicular light of the present invention (1) above, wherein micro diffusion elements that are raised strips that extend in the horizontal direction are formed in succession in the vertical direction on the incident surface, and micro diffusion elements that are raised strips that extend in the vertical direction are formed in succession in the horizontal direction on the light emission surface.

(5) The vehicular light of the present invention (4) above, wherein the micro diffusion elements formed on the light emission surface are formed such that a width of the raised strips becomes smaller from the vertical center toward the vertical outsides.

(6) The vehicular light of the present invention (4), wherein of the micro diffusion elements formed on the light emission surface, the micro diffusion elements of the light emission surface where light incident to the incident surface at an irradiation angle of equal to or greater than a predetermined angle based on the lens optical axis is emitted, when light is radiated onto the incident surface from the basic focal point, are such that a height of the raised strips gradually becomes lower from the vertical center toward the vertical outsides, and there are no micro diffusion elements at the vertical outsides.

EFFECT OF THE INVENTION

According to the present invention, a vehicular light provided with an odd-shaped lens that suppresses light distribution deterioration is able to be provided.

BRIEF DESCRIPTION OF THE DRAWINGS

FIG. 1 is a plan view of a vehicle provided with a vehicular light according to an embodiment of the present invention.

FIG. 2 is a sectional view in the horizontal direction along a lens optical axis of a light unit according to an embodiment of the present invention.

FIG. 3 is a sectional view in the horizontal direction along a lens optical axis of a lens according to an embodiment of the present invention.

FIG. 4 is a view for explaining an incident surface of a lens according to an embodiment of the present invention.

FIG. 5 is a view illustrating a state of light distribution control in the horizontal direction of a lens when there is a light emitting point at a basic focal point according to an embodiment of the present invention.

FIG. 6 is a view illustrating a state of light distribution control in the vertical direction of a lens when there is a light emitting point at a basic focal point according to an embodiment of the present invention.

FIG. 7 is a front view of a light emission surface of a lens according to an embodiment of the present invention.

FIG. 8 is a view for explaining regions of the light emission surface in FIG. 7.

FIG. 9 is a view for explaining a light distribution pattern on a screen formed by light from a light emitting chip on a left end according to an embodiment of the present invention, with (a) being a view in which a light distribution pattern in Comparative example 1 is indicated by iso-intensity lines, and (b) being a view in which a light distribution pattern in the present embodiment is indicated by iso-intensity lines.

MODE FOR CARRYING OUT THE INVENTION

Hereinafter, modes for carrying out the present invention (hereinafter, simply referred to as "embodiments") will be described in detail with reference to the accompanying drawings. Like elements throughout the entire description of the embodiments will be denoted by like numerals. Also, unless otherwise noted, in the embodiments and drawings, "front" and "rear" "indicate a "forward direction" and a "reverse direction," respectively, of the vehicle, and "upper," "lower," left," and "right" all indicate directions from the viewpoint of a driver riding in the vehicle.

A vehicular light according to the embodiment of the present invention is a vehicular front light (101R, 1010 provided on the left and right sides, respectively, at the front of a vehicle 102 shown in FIG. 1, but will hereinafter simply be referred to as vehicular light.

Note that hereinafter, a rectangular lens in which light distribution deterioration is significant, even among odd-shaped lenses, will be described as an example.

The vehicular light of the present embodiment includes a housing (not shown) that is open to the vehicle front side, and an outer lens (not shown) that attaches to the housing so as to cover the opening. A light unit 10 (see FIG. 2) and the like is arranged inside a light chamber formed by the housing and the outer lens.

FIG. 2 is a sectional view in the horizontal direction along a lens optical axis Z of the light unit 10.

Note that in FIG. 2, the X axis indicates the axis in the horizontal direction perpendicular to the lens optical axis Z, and Y indicates a Y axis that is an axis in the vertical direction perpendicular to the lens optical axis Z and the X axis. The Y axis is in the direction perpendicular to the surface of the paper on which the figure is drawn, so only the reference character is shown.

(Light Unit)

As shown in FIG. 2, the light unit 10 of the present embodiment includes a heat sink 20, a light source unit 30 arranged on the heat sink 20, a lens 40 that is arranged on the side in front of the light source unit 30 and has a rectangular outer shape when viewed from the front, and a lens holder 50 that holds flanges 41 of the lens 40 and is mounted to the heat sink 20.

As shown in FIG. 2, the light source unit 30 is such that a plurality of (10) light emitting chips 32 are arranged in the X axis direction (the horizontal direction), and light from these light emitting chips 32 is radiated forward through the lens 40 to form a plurality of (10) light distribution patterns.

These light distribution patterns partially overlap, at least with adjacent light distribution patterns, and these light distribution patterns are lined up in the horizontal direction to form an overall light distribution pattern.

Also, glare light with respect to a leading vehicle is able to be suppressed while radiating light forward, by performing so-called ADB (Adaptive Driving Beam) control that turns some or all of the light emitting chips 32 on/off in accordance with the positional relationship with the leading vehicle and the like.

(Heat Sink)

The heat sink 20 is a member that dissipates heat generated by the light source unit 30. The heat sink 20 is preferably made of metal material with high thermal conductivity (such as aluminum, for example) or resin material.

In the present embodiment, a plate-shaped heat sink 20 is shown, but the shape of the heat sink 20 is arbitrary. For example, heat dissipating fins that extend rearward may be provided on a back surface 21 positioned on the side opposite the surface where the light source unit 30 is arranged.

(Light Source Unit)

The light source unit 30 is an LED light source in which single chip type light emitting chips 32 (LED) are provided on a circuit board 31 on which electrical wiring for supplying power, and the like, not shown, is formed.

In the present embodiment, 10 light emitting chips 32 are arranged in a row in the horizontal direction on the circuit board 31. Light distribution deterioration tends to occur when there are five or more of the light emitting chips 32 arranged, so the effect of the present invention is particularly significant when five or more light emitting chips 32 are arranged.

Also, the number of arrays of the light emitting chips 32 is not limited to one row. Moreover, a plurality of rows of the light emitting chips 32 may be provided in the vertical direction by arranging the light emitting chips 32 in the horizontal direction on both the upper side and the lower side.

Further, it is preferable to have the circuit board 31 be a common circuit board that is shared by all of the light emitting chips 32, as in the present embodiment, as this enables a reduction in size and the number of parts. However, when a plurality of rows of the light emitting chips 32 are provided, for example, the manner in which the circuit board 31 is provided, such as providing one circuit board 31 for each row, may be modified as appropriate.

Note that in the present invention, the light source unit 30 is an LED type light source, but surface-emitting semiconductor lasers may also be used for the light emitting chips 32.

(Lens Holder)

The lens holder 50 is not particularly limited in terms of shape and the like as long the lens 40 is able to be arranged in a predetermined position on the side in front of the light source unit 30.

Also, in addition to the function of arranging the lens 40, the lens holder 50 may have a structure that surrounds the lens 40 so that it also functions to block the light that does not enter the lens 40, of the light radiated from the light source unit 30.

(Lens)

The lens 40 is made of transparent resin material such as polycyclohexylene dimethylene terephthalate (PCT), polycarbonate (PC), or an acrylic resin such as PMMA, for example.

Typically, even with the same material, the refractive index is different if the wavelength is different. When the wavelength dependence of the refractive index is large, spectroscopy tends to occur, and a blue spectral color tends to appear in part of the light distribution pattern.

Therefore, of these materials, an acrylic resin such as PMMA in which the wavelength dependence of the refractive index is small is preferable.

As shown in FIG. 2, the lens 40 has a convex-shaped incident surface 42 on the light source unit 30 side (the rear side) into which the light from the light source unit 30 is incident, and a convex-shaped light emission surface 43 in the direction away from the light source unit 30 (on the front side), from which the incident light is emitted. The incident surface 42 and the light emission surface 43 are each formed with a freeform curve.

Hereinafter, the incident surface 42 and the light emission surface 43 will be described in detail.

(Incident Surface)

FIG. 3 is a sectional view of only the lens 40, in the horizontal direction along the lens optical axis Z, similar to FIG. 2.

As shown in FIG. 3, the incident surface 42 is a portion (see area A) to the inside of the flanges 41 provided on the left and right. The curvature radius at the position intersecting with the lens optical axis Z (hereinafter, this position will also be referred to as the center point O), i.e., at the lateral center of the lens 40, is R1. Also, the incident surface 42 is formed with a freeform curve in which the curvature radius gradually increases in a continuous fashion from the lens optical axis Z toward the outsides, and the curvature radii on the outsides are R2 and R3 ($R1<R2\approx R3$). The curvature radii R2 and R3 are preferably between two and three times, inclusive, the curvature radius R1.

Hereinafter, the manner in which the incident surface 42 is set will be described in more detail with reference to FIG. 4.

Lens L shown in FIG. 4 is a horizontal sectional view of a lens L having the basic shape of the lens 40 of the present embodiment.

FIG. 4 shows an example of a state in which a light beam parallel to the optical axis P of the lens L is incident to the lens L from one surface S1 and is emitted from the other surface S2. An extension line of the light beam before being incident to the one surface S1 and an extension line of the light beam after being emitted from the other surface S2 are indicated by alternate long and short dash lines, and the point where these extension lines intersect (see the point where the alternate long and short dash lines intersect) is point D.

Also, when the point of incidence of the light beam that is incident to the one surface S1 is changed along the one surface S1, and point D is obtained in the same manner as described above, the trajectory of the point D is as indicated by the dotted line. The trajectory indicated by this dotted line is the principal surface SML of the lens L.

Also, the point where the optical axis P of the lens L and the principal surface SML intersect is the principal point SP of the lens L.

When the principal surface SML is a true circle (circle of Apollo) centered around the basic focal point BF, coma aberration disappears. Therefore, in order to suppress coma aberration of the lens L, the other surface S2 need simply be formed such that the distance K between the point D and the basic focal point BF of the lens L is constant at a focal length F.

Here, when a sine condition violation amount $OSC=K-F$ is defined as an evaluation amount representing the degree of coma aberration, and the sine condition violation amount OSC is obtained along the principal surface SML, coma aberration is suppressed the closer these values are to zero.

However, considering the fact that, in a vehicular light, a plurality of light distribution patterns are formed overlapping, like a matrix beam or the like, using an odd shaped lens, in particular, when simply forming the other surface S2 such that the sine condition violation amount $OSC=0$, coma aberration is improved, but the light/dark boundary becomes too distinct. As a result, the light distribution ends up becoming uneven or streaked at portions where a plurality of light distribution patterns overlap.

Therefore, the other surface S2 is formed such that the sine condition violation amount OSC is reduced to suppress coma aberration of the lens L, while inhibiting the light distribution from becoming uneven or streaked.

Note that because $K=W/\sin\theta'$, the sine condition violation amount OSC can be written as sine condition violation amount $OSC=W/\sin\theta'-F$.

Also, in the description above, a case is illustrated in which a light beam is incident from the one surface S1 and a light beam is emitted from the other surface S2, but if the orientation of the lens L is reversed, a light beam would be incident from the other surface S2 and a light beam would be emitted from the one surface S1.

Therefore, as a result of trying various conditions such as keeping the curvature radius of the other surface S2 constant or changing the curvature radius of the other surface S2, it was found that coma aberration is able to be significantly suppressed while inhibiting the light distribution from becoming uneven or streaked, by forming the other surface S2 with a freeform curve such that the curvature radius gradually increases in a continuous fashion from the lateral center of the lens L toward the outsides.

As a specific example, the sine condition violation amount OSC in a case where the curvature radius of the lateral center of the lens L of the other surface S2 is set to 100 mm, and the curvature radius is increased in a continuous fashion from the lateral center of the lens L toward the outsides, and the curvature radius at the left and right outsides (left end and right end) of the lens L is set to 240 mm (Example 1), and a case where the curvature radius is set to 100 mm, and the curvature radius does not change from the lateral center of the lens L to the left and right outsides (left end and right end) (Comparative example 1), is shown in Table 1 below.

Note that in Table 1, the sine condition violation amount OSC from the lateral center of the lens L toward one outside (the left end or the right end) is obtained, but in Example 1 and Comparative example 1, the other surface S2 is symmetrical with reference to the lateral center of the lens L, so the result would be the same if the sine condition violation amount OSC from the lateral center of the lens L toward the other outside (the right end or the left end) were obtained.

TABLE 1

| | Sine condition violation amount | | | | | | | |
|---|---|---|---|---|---|---|---|---|
| | Center point O side | | | | | | | ⇔ |
| Example 1 | 0.000 | −0.005 | 0.014 | 0.021 | 0.018 | 0.005 | −0.015 | −0.041 |
| Comparative example 1 | 0.000 | −0.005 | −0.021 | −0.046 | −0.079 | −0.119 | −0.163 | −0.208 |
| | Sine condition violation amount | | | | | | | |
| | | | | | | | | Outside |
| Example 1 | −0.056 | −0.067 | −0.076 | −0.083 | −0.087 | −0.087 | −0.083 | −0.072 |
| Comparative example 1 | −0.253 | −0.294 | −0.328 | −0.355 | −0.369 | −0.371 | −0.358 | −0.328 |

As can be seen from Table 1, in the lateral center (left-right center) of the lens L, in both Example 1 and Comparative example 1, the sine condition violation amount OSC is 0.0, and the sine condition violation amount OSC tends to increase farther to the outside. However, in Comparative example 1, the worst sine condition violation amount OSC is −0.371, but in Example 1, the worst sine condition violation amount OSC is kept down to −0.087, so an improvement by more than one digit can be seen. Also, it is evident that the sine condition violation amount OSC is reduced to such an extent that the numerical value in Example 1 is almost zero.

In this way, coma aberration is able to be suppressed by forming the other surface S2 such that the curvature radius gradually increases from the lateral center of the lens L toward the outsides.

On the other hand, the vertical cross-section of the other surface S2 may be a single convex shape in which the curvature radius is constant without being changed. However, upon further investigation, it was confirmed that, when viewed in the vertical direction (the direction perpendicular to the paper on which the figure is drawn) from the lateral center of the lens L as well, coma aberration is able to be even better suppressed by forming the other surface S2 such that the curvature radius gradually increases in a continuous fashion from the lateral center of the lens L (the vertical center of the lens L) toward the outsides.

Therefore, when viewed in the vertical direction (the direction perpendicular to the paper on which the figure is drawn) from the lateral center of the lens L as well, it is preferable to form the other surface S2 such that the curvature radius gradually increases in a continuous fashion from the lateral center of the lens L (the vertical center of the lens L) toward the outsides.

In addition, even in a diagonal direction from the lateral center of the lens L (the vertical center of the lens L), i.e., even in diagonally upper left-right directions or diagonally lower left-right directions from the lateral center of the lens L (the vertical center of the lens L), it has been confirmed that it is preferable to gradually increase the curvature radius in a continuous fashion from the lateral center of the lens L (the vertical center of the lens L) toward the outsides to suppress coma aberration.

From this, it is most preferable that the other surface S2 be formed with a freeform curve in which the curvature radius changes so as to become larger farther toward the outsides in a continuous fashion radially from the lateral center of the lens L (the vertical center of the lens L).

With the lens 40 of the present embodiment, the other surface S2 formed by a freeform curve that suppresses coma aberration, is obtained based on the lens L having the basic shape of the lens 40, and the shape of the freeform curve of the obtained other surface S2 is the shape of the incident surface 42.

That is, the incident surface 42 of the lens 40 of the present embodiment shown in FIG. 3 is formed with a freeform curve in which the curvature radius changes so as to increase in a continuous fashion toward the outsides, in the radial direction based on the center point O.

More specifically, the incident surface 42 of the lens 40 of the present embodiment is similar to that illustrated in Example 1, i.e., the curvature radius at the center point O is set to 100 mm, and the curvature radius then increases in a continuous fashion toward the left and right outsides (the outsides in the horizontal direction), and the curvature radius becomes 240 mm at the outermost sides in the left-right direction (the outermost sides in the horizontal direction). Also, the curvature radius increases from the center point O toward the outsides in a continuous fashion also in the vertical direction, and the diagonal directions (the diagonally upper left-right directions and the diagonally lower left-right directions).

However, this is merely an example. The curvature radius at the center point O and the curvature radius at the outsides that is achieved by changing, i.e., increasing, the curvature radius in a continuous fashion from the center point O, are adjusted according to the size of the lens 40 and the like, for example.

(Light Emission Surface)

Next, the light emission surface 43 of the lens 40 will be described. The shape of the light emission surface 43 is determined so as to form a predetermined light distribution pattern by controlling the light distribution of light emitted when light incident to the incident surface 42 that has been made to suppress the coma aberration described above is radiated forward from the light emission surface 43.

Therefore, the shape of the light emission surface 43 is determined, after determining the shape of the incident surface 42, such that suitable light distribution control is possible.

Hereinafter, the light emission surface 43 will be described in detail with reference to FIG. 5 and FIG. 6.

FIG. 5 is a sectional view in the horizontal direction along the lens optical axis Z of the lens 40. That is, FIG. 5 is a view showing a cross-section of the lens 40 in the same direction as FIG. 2.

Also, FIG. 6 is a sectional view in the vertical direction along the lens optical axis Z of the lens 40.

Note that in FIG. 5, the flange 41 portions of the lens 40 are omitted. Only the incident surface 42 and the light emission surface 43 are shown.

In FIG. 5 and FIG. 6, the X axis, the Y axis, and the Z axis shown centered around the basic focal point BF of the lens 40 are just as described in FIG. 2, with Z being the lens optical axis Z, the axis in the horizontal direction perpendicular to the lens optical axis Z being the X axis, and the axis in the vertical direction perpendicular to the Z axis and the X axis being the Y axis.

Note that in FIG. 5, the Y axis is in the direction perpendicular to the surface of the paper on which the figure is drawn, and in FIG. 6, the X axis is in the direction perpendicular to the surface of the paper on which the figure is drawn.

Also, FIG. 5 and FIG. 6 show the manner in which light incident to the lens 40 from the incident surface 42 is radiated forward from the light emission surface 43, when a light emitting point is provided at the basic focal point BF, and light is radiated onto the incident surface 42 from this basic focal point BF on the lens optical axis Z.

As shown in FIG. 5, light radiated onto the incident surface 42 from the basic focal point BF on the lens optical axis Z is then radiated forward from the light emission surface 43 so as to gradually spread toward the outside from the lens optical axis Z when viewed in the horizontal direction.

More specifically, light radiated forward from the light emission surface 43 on the left side of the lens optical axis Z is radiated toward the front left so as to gradually spread out approximately 1 degree toward the outside from the lens optical axis Z, while light radiated forward from the light emission surface 43 on the right side of the lens optical axis Z is radiated toward the front right so as to gradually spread out approximately 1 degree toward the outside from the lens optical axis Z.

On the other hand, as shown in FIG. 6, light radiated onto the incident surface 42 from the basic focal point BF on the lens optical axis Z is radiated forward from the light emission surface 43 so as to gradually spread upward approximately 1 degree, on the side above the lens optical axis Z when viewed in the vertical direction, and is radiated forward from the light emission surface 43 in a parallel fashion, on the side below the lens optical axis Z when viewed in the vertical direction.

In the present embodiment, light is radiated forward from the light emission surface 43 in a parallel fashion on the side below the lens optical axis Z, but the lower part of the lens 40 that tends to affect the generation of spectral color away from the lens optical axis Z may also be adjusted such that the direction in which light is emitted shifts from being parallel (e.g., the lower part of the lens 40 may be adjusted such that light is emitted slightly upward), while the light emission surface 43 is basically formed such that light is emitted in a parallel fashion, on the side below the lens optical axis Z.

In this way, in the present embodiment, the light emission surface 43 of the lens 40 is formed with a freeform curve such that, when light is radiated onto the incident surface 42 from the basic focal point BF on the lens optical axis Z, the light radiated forward from the light emission surface 43 gradually spreads toward the outside from the lens optical axis Z when viewed in the horizontal direction, and gradually spreads upward on the side above the lens optical axis Z and is parallel on the side below the lens optical axis Z, when viewed in the vertical direction.

Note that, as described above, an adjustment may be made in relation to the spectral color, so the light emission surface 43 of the lens 40 may be formed with a freeform curve that includes one in which, when light is radiated onto the incident surface 42 from the basic focal point BF on the lens optical axis Z, the light is parallel on the side below the lens optical axis Z when viewed in the vertical direction.

Also, in the actual light unit 10, the light source unit 30 is such that the light emitting chips 32 are arranged in positions a distance C behind the basic focal point BF, as shown in FIG. 2, with respect to the lens 40 formed in this way.

More specifically, in the present embodiment, that the distance C is set to 0.5 mm, and the light emitting chips 32 are arranged such that the position of the front surface of the light emitting chips 32 is 0.5 mm behind the basic focal point BF in the front-rear direction along the lens optical axis Z.

When the light emitting chips 32 are arranged behind the basic focal point BF in this way, light is radiated slightly inward on the whole compared to the state in which light is radiated forward from the light emission surface 43 described with reference to FIG. 5 and FIG. 6. Therefore, the width of the spread in the horizontal direction of the light distribution pattern becomes an appropriate width, and the width of the spread in the vertical direction also becomes an appropriate width, and the blue spectral color due to spectroscopy can be suppressed.

More specifically, with a light distribution pattern formed by light radiated forward from the light emission surface 43 on the side above the lens optical axis Z of the lens 40, a red spectral color tends to appear on the upper side and a blue spectral color tends to appear on the lower side. On the other hand, with a light distribution pattern formed by light radiated forward from the light emission surface 43 on the side below the lens optical axis Z of the lens 40, conversely, a blue spectral color tends to appear on the upper side and a red spectral color tends to appear on the lower side. Here, the light radiated forward from the light emission surface 43 on the upper side does not travel upward much, while the light radiated forward from the light emission surface 43 on the lower side travels upward slightly, due to the light emitting chips 32 being positioned behind the basic focal point BF. Also, with a light distribution pattern on a screen, light radiated forward from the light emission surface 43 on the upper side and light radiated forward from the light emission surface 43 on the lower side mix together so as to cancel out the effect of spectroscopy, which makes it possible to suppress the blue spectral color from appearing in the light distribution pattern.

With the light unit 10 of the present embodiment, the overall light distribution pattern is formed by the light distribution patterns that are formed by the plurality of (10) light emitting chips 32 appearing to be lined up in the horizontal direction such that light distribution patterns that are adjacent on the screen partially overlap, as described above.

Therefore, streaks due to a difference in luminosity may appear at the boundary lines of the overlapping light distribution patterns.

In order to inhibit these streaks from appearing, in the lens 40 of the present embodiment, although not shown, micro diffusion elements are provided on the incident surface 42 and the light emission surface 43 to blur the outer contours of the light distribution patterns formed by the light from the light emitting chips 32.

Hereinafter, these micro diffusion elements will be described in detail.

Micro diffusion elements that are raised strips that extend in the horizontal direction are formed in succession in the vertical direction on the incident surface 42.

In other words, to make it easy to image, micro diffusion elements having semi-cylindrical prism shapes that are curved along the horizontal direction of the incident surface 42 are stacked in succession in the vertical direction.

Note that when the incident surface 42 is viewed in a vertical cross-section, the micro diffusion elements having semi-cylindrical prism shapes appear stacked in succession in the vertical direction, so the surface of the incident surface 42 has the shape of a series of gently wavy asperities.

On the other hand, micro diffusion elements that are raised strips that extend in the vertical direction are formed in succession in the horizontal direction on the light emission surface 43.

In other words, to make it easy to image, micro diffusion elements having semi-cylindrical prism shapes that are curved along the vertical direction of the light emission surface 43 (hereinafter, this kind of shape will also be written as semi-cylindrical prism shape) are continuous in the horizontal direction.

Note that when the incident surface 42 is viewed in a horizontal cross-section, the micro diffusion elements having semi-cylindrical prism shapes appear stacked in succession in the horizontal direction, so the surface of the incident surface 42 has the shape of a series of gently wavy asperities.

By forming these kinds of micro diffusion elements on the incident surface 42 and the light emission surface 43, light incident to the lens 40 from the incident surface 42 spreads out in the vertical direction, so the light distribution patterns that are formed are blurred in the vertical direction. Also, when light is emitted from the light emission surface 43, the emitted light spreads out in the left-right direction, so the light diffusion patterns are blurred in the left-right direction.

Here, the light emission surface 43 has a convex shape on the front side, so each of the micro diffusion elements formed on the light emission surface 43 has a curved slope that slopes upward from the front side toward the rear side, on the side above the vertical center of the lens 40. On the other hand, the light emission surface 43 on the side below the vertical center of the lens 40 has a curved slope that slopes downward from the front side toward the rear side.

Consequently, there are cases with the light distribution pattern formed by the light emitted from the upper side of the lens 40 where the horizontal end side of the light distribution pattern drops below the center. Conversely, there are cases with the light distribution pattern formed by the light emitted from the lower side of the lens 40 where the horizontal end side of the light distribution pattern rises above the center.

Therefore, the micro diffusion elements formed on the light emission surface 43 are preferably such that the width of the raised strips becomes smaller from the vertical center toward the vertical outsides.

In other words, the micro diffusion elements formed on the light emission surface 43 are preferably formed in conical prism shapes such that the width of the semi-cylindrical prism shapes becomes gradually smaller from the vertical center toward the vertical upper side, and the width of the semi-cylindrical prism shapes becomes gradually smaller also toward the vertically lower side.

In this way, the micro diffusion elements are such that both end portions of the arc-shaped cross-section are corrected in the direction in which light is radiated upward increasingly toward the upper side of the lens 40, so the ends of the light distribution pattern are inhibited from dropping downward. Similarly, the micro diffusion elements are such that both end portions of the arc-shaped cross-section are corrected in the direction in which light is radiated downward increasingly toward the lower side of the lens 40, so the ends of the light distribution pattern are inhibited from rising upward. Therefore, a good light distribution pattern in which no dropping or rising occurs at both ends of the light distribution pattern is able to be formed.

When light radiated forward from the four corners (the upper left and right ends and the lower left and right ends) of the lens 40 that are the end sides that prevent the lens 40 from being regarded as a circular lens when viewed from the front is emitted forward, light distribution deterioration may be promoted if that light is diffused by the micro diffusion elements.

Therefore, it is preferable to not provide micro diffusion element structures on the light emission surface 43 at the four corners (the upper left and right ends and the lower left and right ends) of the lens 40.

Thus, in the present embodiment, the micro diffusion elements formed on the light emission surface 43 are as shown in FIG. 7.

FIG. 7 is a front view of the light emission surface 43 in which only the light emission surface 43 of the lens 40 is shown.

Note that the X, Y, and Z axes in FIG. 7 are the same as they have been thus far. Outlines of the micro diffusion elements are shown by lines in FIG. 7.

Before describing the micro diffusion elements with reference to FIG. 7, just what kind of region region 43*a* and regions 43*b* of the light emission surface 43 shown in FIG. 7 are will be described with reference to FIG. 8.

FIG. 8 is a horizontal sectional view along the lens optical axis Z of the lens 40, similar to FIG. 5.

Note that the flanges 41 are also omitted from FIG. 8, just as they are in FIG. 5.

Also, FIG. 8 illustrates a case in which there is a light emitting point at the basic focal point BF. The region of the light emission surface 43 where light incident to the incident surface 42 in a range where the irradiation angle θ of light radiated onto the incident surface 42 is smaller than a predetermined angle, based on the lens optical axis Z, as shown in FIG. 8, of the light radiated onto the incident surface 42 from the basic focal point BF, is emitted is the region 43*a*. On the other hand, the regions of the light emission surface 43 where light incident to the incident surface 42 in a range where the irradiation angle is equal to or greater than the predetermined angle is emitted are the regions 43*b*.

More specifically, in the present embodiment, the predetermined angle is 25 degrees, so the region of the light emission surface 43 where light incident to the incident surface 42 in a range where the irradiation angle θ is smaller than 25 degrees is emitted is the region 43*a*, and the regions of the light emission surface 43 where light incident to the incident surface 42 in a range where the irradiation angle is equal to or greater than 25 degrees is emitted are the regions 43*b*.

Also, as can be seen from FIG. 7, the regions 43*b* of the light emission surface 43 are regions that include the four corners (the upper left and right ends and the lower left and right ends) of the lens 40.

Thus, with the micro diffusion elements formed on the light emission surface 43 in these regions 43*b*, the height of the raised strips gradually becomes lower from the vertical center toward the vertical outsides (the upper side and the lower side), and there are no micro diffusion elements on the vertical outsides (the upper end and the lower end), as shown in FIG. 7.

One example of a light distribution pattern formed by the light unit 10 of the embodiment having the structure described above is shown in FIG. 9.

FIG. 9 is a view showing the light distribution pattern on a screen indicated by iso-intensity lines. VU-VD indicate vertical lines, and HL-HR indicate horizontal lines. FIG. 9 shows a light distribution pattern formed by light from light emitting chips 32' that are positioned on the left side of the vehicle, of the light emitting chips 32 in FIG. 2.

Note that the effect of light distribution deterioration by coma aberration is more likely to occur with light distribution patterns formed by light from the light emitting chips 32 positioned farther to the outside. Therefore, a light distribution pattern formed by light from light emitting chips 32 positioned farther toward the center than the light emitting chips 32 that are positioned farther to the outside will be even less affected by coma aberration than the state shown in FIG. 9.

FIG. 9(*a*) shows the light distribution pattern with the incident surface described in Comparative example 1 described above, i.e., in a case where the curvature radius of the incident surface is constant at 100 mm, and FIG. 9(*b*) shows the light distribution pattern of the present embodiment.

The portions encircled by the dotted lines in FIG. 9(*a*) are portions where light distribution deterioration is occurring due to the effect of coma aberration. The upper left side and the lower left side of the light distribution pattern become positioned to the left side of the center portion, such that the light distribution pattern deteriorates from a rectangular shape. On the other hand, with the present embodiment shown in FIG. 9(*b*), it is evident that such light distribution deterioration does not occur.

Note that the dotted line in FIG. 9(*b*) schematically shows the outline contour of an adjacent light distribution pattern in order to show the overlapping state of the adjacent light distribution pattern.

Although the present invention has heretofore been described based on a specific embodiment, the present invention is not limited to the above embodiment.

In the present embodiment, the regions 43*b* where the height of the raised strips of the micro diffusion elements of the light emission surface 43 becomes lower from the center toward the outsides in the vertical direction are the areas of the light emission surface 43 where light incident from the basic focal point BF to the incident surface 42 at an irradiation angle θ of equal to or greater than 25 degrees (a predetermined angle) based on the lens optical axis Z, is emitted, but the predetermined angle of this irradiation angle θ may be set within a range between 20 degrees and 30 degrees, inclusive.

The above embodiment has been described with a rectangular-shaped lens in which light distribution deterioration is significant, even among odd-shaped lenses, of odd-shaped lenses (for example, a rectangular (a rhombus or a parallelogram)-shaped lens or a lens with a shape that is not a true circle but is enclosed by a curved line as represented by an ellipse). However, the present invention is not limited to a rectangular-shaped lens, and may naturally be a lens with another odd shape.

Even with a lens having another odd shape, coma aberration can be suppressed by increasing the curvature radius in a continuous fashion from the center of the lens toward the outsides of the lens, similar to that described in the embodiment.

In this way, the present invention is not limited to a specific embodiment. Modifications and improvements that do not depart from the technical aspects are also included in the technical scope of the invention, and this is evident from the description of the scope of the claims for patent.

DESCRIPTION OF REFERENCE NUMERALS

10 Light unit
20 Heat sink
21 Back surface
30 Light source unit
31 Circuit board
32 Light emitting chips
40 Lens
41 Flange
42 Incident surface
43 Light emission surface
43*a*, 43*b* Regions of light emission surface
50 Lens holder
F Focal length
BF Basic focal point
D Point of intersection
K Distance
L Lens
OSC Sine condition violation amount
P Optical axis
S1 One surface
S2 Other surface
SML Principal surface
SP Principal point
O Center point
Z Lens optical axis
101L, 101R Vehicular front lights
102 Vehicle

The invention claimed is:

1. A vehicular light comprising:

a light source unit having at least five or more light emitting chips arranged in a horizontal direction; and an odd-shaped lens having a convex-shaped incident surface on the light source unit side and a convex-shaped light emission surface in a direction away from the light source unit, wherein the incident surface is formed with a freeform curve arranged so that a curvature radius of the freeform curve in at least the horizontal direction gradually becomes larger in a continuous fashion from a lateral center of the lens to the horizontal end thereof.

2. The vehicular light according to claim 1, wherein the incident surface is formed such that the curvature radius gradually increases from the lens optical axis toward the outside in a radial fashion including the vertical direction and a diagonal direction.

3. The vehicular light according to claim 1, wherein the odd-shaped lens has a parallelogram outer shape.

4. The vehicular light according to claim 1, wherein the curvature radius on the outside of the incident surface has a curvature radius of 2 to 3 times a curvature radius at the lens optical axis.

5. The vehicular light according to claim 1, wherein the incident surface is formed with the freeform curve in which a curvature radius in the vertical direction also increases in a monotonic fashion from the lens optical axis toward an outside.

6. A vehicular light comprising:

a light source unit having at least five or more light emitting chips arranged in a horizontal direction; and an odd-shaped lens having a convex-shaped incident surface on the light source unit, side and convex-shaped light emission surface in a direction away from the light source unit, wherein the incident surface is formed with a freeform curve in which a curvature radius in the horizontal direction gradually increases from a lens optical axis toward an outside, wherein the light emission surface is formed with a freeform curve including one in which, when light is radiated onto the incident surface from a basic focal point on the lens optical axis, light radiated forward from the light emission surface gradually spreads toward the outside from the lens optical axis when viewed in the horizontal direction, and gradually spreads upward on a side above the lens optical axis, and is parallel on a side below the lens optical axis when viewed in a vertical direction, and the light source unit is arranged such that the light emitting chips are positioned behind the basic focal point.

7. A vehicular light comprising:

a light source unit having at least five or more light emitting chips arranged in a horizontal direction; and an odd-shaped lens having a convex-shaped incident surface on the light source unit side and a convex-shaped light emission surface in a direction away from the light source unit, wherein the incident surface is formed with a freeform curve in which a curvature radius in the horizontal direction gradually increases from a lens optical axis toward an outside, wherein micro diffusion elements that are raised strips that extend in the horizontal direction are formed in succession in the vertical direction on the incident surface, and micro diffusion elements that are raised strips that extend in the vertical direction are formed in succession in the horizontal direction on the light emission surface.

8. The vehicular light according to claim 7, wherein the micro diffusion elements formed on the light emission surface are formed such that a width of the raised strips becomes smaller from the vertical center toward the vertical outsides.

9. The vehicular light according to claim 7, wherein of the micro diffusion elements formed on the light emission surface, the micro diffusion elements of the light emission surface where light incident to the incident surface at an irradiation angle of equal to or greater than a predetermined angle based on the lens optical axis is emitted, when light is radiated onto the incident surface from the basic focal point, are such that a height of the raised strips gradually becomes lower from the vertical center toward the vertical outsides, and there are no micro diffusion elements at the vertical outsides.

* * * * *